US006625955B2

(12) United States Patent
Aylward

(10) Patent No.: US 6,625,955 B2
(45) Date of Patent: Sep. 30, 2003

(54) METHODS FOR FORMING PRODUCT PACKAGE WITH RECLOSEABLE LOCKING MECHANISM

(75) Inventor: John Thomas Aylward, New Bern, NC (US)

(73) Assignee: Aylward Enterprises, Inc., New Bern, NC (US)

( * ) Notice: Subject to any disclaimer, the term of this patent is extended or adjusted under 35 U.S.C. 154(b) by 0 days.

(21) Appl. No.: 09/891,232

(22) Filed: Jun. 25, 2001

(65) Prior Publication Data

US 2002/0023414 A1 Feb. 28, 2002

Related U.S. Application Data

(60) Provisional application No. 60/214,506, filed on Jun. 28, 2000, and provisional application No. 60/293,833, filed on May 25, 2001.

(51) Int. Cl.[7] ..... B65B 61/18

(52) U.S. Cl. ..... 53/412; 53/478; 53/133.4; 53/139.2; 53/141; 53/329.3

(58) Field of Search ..... 53/412, 478, 133.4, 53/139.2, 141, 329.3

(56) References Cited

U.S. PATENT DOCUMENTS

| | | | | | |
|---|---|---|---|---|---|
| 2,177,863 | A | | 10/1939 | Cadden, et al. | |
| 2,422,605 | A | | 6/1947 | Wells | |
| 2,917,162 | A | | 12/1959 | Horland | |
| 3,018,921 | A | | 1/1962 | Hermanson | |
| 3,164,478 | A | | 1/1965 | Bostrom | |
| 3,491,509 | A | * | 1/1970 | Wright | 53/478 |
| 3,786,982 | A | | 1/1974 | Rakes et al. | |
| 3,904,074 | A | | 9/1975 | Hoffman et al. | |
| 4,495,749 | A | * | 1/1985 | Faller | 493/52 |
| 4,496,052 | A | * | 1/1985 | Nertman | 206/461 |
| 4,502,612 | A | | 3/1985 | Morrison | |
| 4,512,474 | A | | 4/1985 | Harding | |
| 4,538,731 | A | | 9/1985 | Cillario | |
| 4,739,883 | A | | 4/1988 | Mohs et al. | |
| 4,886,204 | A | | 12/1989 | Kalmanides | |
| 5,010,714 | A | * | 4/1991 | Medwed et al. | 29/521 |
| 5,012,927 | A | | 5/1991 | Borst | |
| 5,031,768 | A | | 7/1991 | Fischer | |
| 5,046,659 | A | | 9/1991 | Warburton | |
| 5,123,539 | A | | 6/1992 | de Vries et al. | |
| 5,147,035 | A | | 9/1992 | Hartman | |
| 5,154,293 | A | | 10/1992 | Gould | |
| 5,163,269 | A | * | 11/1992 | Williams | 53/412 |
| 5,169,014 | A | | 12/1992 | Hexamer | |
| 5,331,791 | A | * | 7/1994 | Fux et al. | 53/373.7 |
| 5,549,204 | A | | 8/1996 | Toren | |
| 5,582,665 | A | * | 12/1996 | Eigen et al. | 156/292 |
| 5,584,408 | A | | 12/1996 | Orkisz | |
| 5,865,307 | A | | 2/1999 | Friedman | |
| 5,947,294 | A | | 9/1999 | Omata et al. | |
| 6,070,723 | A | | 6/2000 | Lewis | |
| 6,095,364 | A | | 8/2000 | Dickie et al. | |

* cited by examiner

*Primary Examiner*—Ted Kavanaugh
(74) *Attorney, Agent, or Firm*—Alston & Bird LLP

(57) ABSTRACT

Methods of forming a thermoformed recloseable flat package for a pill-like product are provided. A first enclosure portion having a closing member is first operably engaged with a second enclosure portion so as to form an enclosure for containing the product therein. One or more components of a locking mechanism are then formed, following formation of the enclosure, wherein the locking mechanism generally comprises a first component operably engaging the closing member and a cooperable second component operably engaging the second enclosure portion. The components of the locking mechanism are further configured to be separable so as to allow separation thereabout of the closing member from the second enclosure portion to thereby define the recloseable package capable of selectively allowing the product to be extracted from the enclosure.

11 Claims, 7 Drawing Sheets

METHODS FOR FORMING PRODUCT PACKAGE WITH RECLOSEABLE LOCKING MECHANISM

CROSS-REFERENCE TO RELATED APPLICATIONS

This application claims the benefit of U.S. Provisional Patent Application No. 60/214,506, filed Jun. 28, 2000 and U.S. Provisional Patent Application No. 60/293,833 entitled "Product Package With Thermoformed Locking Feature," filed May 25, 2001, both of which are incorporated herein by reference.

FIELD OF THE INVENTION

The present invention relates to product packages and, more particularly, to methods of forming a rigid package having a recloseable locking mechanism so as to allow the removal of consumable products, such as candy items, from the package.

BACKGROUND OF THE INVENTION

In the packaging of various consumable products, such as candy items and the like, various package constructions have been proposed. For example, in the case of mints, which can be shaped as pills or tablets, various rigid and soft packages have been created that allow the opening and reclosing of the package so that the consumer can open and reclose the package to consume mints only when desired. Such packages include paper or foil rolls, tin cans having openable and closable lids and rigid plastic containers having hinged flaps that are molded to allow the flap to lock or snap shut when the package is closed.

One type of package that has proven to be popular is a "credit card" type package for packaging small pill-shaped mints. These packages are formed of two injection molded halves of polystyrene or polypropylene snapped together to define a cavity for the mints. The two halves have plan dimensions that are approximately the same as conventional credit cards although when snapped together with mints therebetween, the package is somewhat thicker than a conventional credit card. Thus, the two halves are generally flat and when combined define a seam extending around the peripheral edge of the package. At one corner of one of the halves a hinge is provided so that a corner portion can be bent back and mints can be released from the package through the opening formed by the corner portion. The corner portion is provided with a recess on an inner surface that mates with a corresponding projection on the other half of the package. Accordingly, when closed, the recess of the corner portion interlocks with the projection of the opposing half to prevent inadvertent opening of the package, such as may occur with other package types when placed in a purse or pocket of the consumer. The credit card-type packages can hold, for example, 50 mints and can be opened and closed a corresponding number of times to allow dispensing of individual mints.

When packaged by the manufacturer, the credit card-type packages are overwrapped with a plastic film wrapper, such as a polyester, polypropylene or cellophane film. The film wrapper serves two purposes. First, the film wrapper provides a moisture barrier to prevent moisture from contaminating the mints packaged therein. Although fitting together closely, the two molded halves of the package do not by themselves form a hermetic seal. Accordingly, the film wrapper provides a moisture barrier which prevents moisture, such as humidity in tropical climates, from permeating to the mints during shipping and while stored or displayed at the point of purchase. The consumer first peels away the film wrapper, which may be provided with a tear strip, and then bends back the corner portion of one of the molded halves of the package.

A second purpose of the plastic wrapper is to provide tamper-evident protection. To prevent tampering with the mints during the shipping, storage and display stages of the retail process, the film wrapper provides visible evidence in the event an attempt is made to tamper with the product. The consumer can easily determine whether the package has been previously opened, or an attempt has been made to open the package, by visually inspecting the integrity of the film wrapper.

Conventional credit card-type packages have several disadvantages. First, the injection molding process for forming the halves of the package is relatively expensive and involves the tooling costs and cycle times associated with injection molding processes. In addition, the halves are often assembled by hand which entails the attendant labor costs and assembly times normally associated with manual labor.

Another manufacturing technique that has been used in connection with other packages, such as blister packages for pharmaceuticals, involves thermoforming a thermoplastic web of material into a desired shape. A generally flat web of material is advanced through a thermoforming station which is provided with opposed dies having corresponding projections and depressions. The dies are closed and heat and pressure are applied to the web of material to plastically deform the material into the desired shape. Upon cooling, at least part of a package is formed, such as the blister portion of a conventional blister package. A foil lidstock is often then heat sealed to the blister portion to seal the package closed. The thermoforming process is relatively inexpensive and can provide high throughput.

However, one disadvantage of thermoformed packages is that the packages generally cannot be opened and reclosed such that the package is locked when reclosed. For example, once the foil lidstock has been peeled back, it typically cannot be securely reclosed. Accordingly, there is a need in the industry for a package which achieves the benefits of thermoforming processes, namely lower cost and higher processing speeds, while at the same time providing the recloseable features of conventional injection molded packages wherein certain edges and surfaces of the molded pieces can be shaped to interlock when the package is closed.

A further disadvantage of conventional credit card-type packages is the need to overwrap the package with a plastic wrapper. The wrapping of these packages involves an extra processing step during manufacture and also requires a corresponding unwrapping step on behalf of the consumer. Accordingly, it would be advantageous to provide a credit card type-package that retains both the moisture barrier and tamper-evident properties of conventional credit card-type packages but yet which does not require a separate plastic wrapper around the package.

All of these desirable attributes are advantageously provided by the present invention as discussed further below.

SUMMARY OF THE INVENTION

The above and other needs are met by the present invention which, in one embodiment, provides a method of forming a thermoformed recloseable flat package for a pill-like product. A first enclosure portion having a closing member is first operably engaged with a second enclosure portion so as to form an enclosure for containing the product therein. Each enclosure portion has a major surface such that the major surfaces of the respective enclosure portions are generally parallel when the first and second enclosure portions are operably engaged. A component of a locking mechanism is then formed, following formation of the enclosure. The locking mechanism generally comprises a first component operably engaging the closing member and a second component operably engaging the second enclosure portion. The first component corresponds to, and is configured to operably engage, the second component to secure the closing member to the second enclosure portion. The components of the locking mechanism are further configured to be separable so as to allow separation thereabout of the closing member from the second enclosure portion. A recloseable package capable of selectively allowing the product to be extracted from the enclosure is thereby defined.

Another advantageous aspect of the present invention comprises a method of forming a thermoformed recloseable flat package for a pill-like product, wherein a first enclosure portion having a closing member is first operably engaged with a second enclosure portion defining at least one aperture component of a locking mechanism so as to form an enclosure for containing the product therein. Each enclosure portion has a major surface such that the major surfaces of the respective enclosure portions are generally parallel when the first and second enclosure portions are operably engaged. A projection component of the locking mechanism is then formed from the closing member, following formation of the enclosure. The projection component corresponds to, and is configured to operably engage, the at least one aperture component to secure the closing member to the second enclosure portion. The components of the locking mechanism are further configured to be separable so as to allow separation thereabout of the closing member from the second enclosure portion.

Still another advantageous aspect of the present invention comprises a method of forming a thermoformed recloseable flat package for a pill-like product, wherein a first enclosure portion having a pivotable closing member is first operably engaged with a second enclosure portion defining at least one lip component of a locking mechanism so as to form an enclosure for containing the product therein. Each enclosure portion has a major surface such that the major surfaces of the respective enclosure portions are generally parallel when the first and second enclosure portions are operably engaged. A projection component of the locking mechanism is then formed from the closing member, following formation of the enclosure. The projection component corresponds to, and is configured to operably engage, the at least one lip component in an interference fit, with respect to pivoting of the closing member, to secure the closing member to the second enclosure portion. The projection component is further configured to be separable from the at least one lip component so as to allow separation thereabout of the closing member from the second package portion.

Yet another advantageous aspect of the present invention comprises a method of forming a thermoformed recloseable flat package for a pill-like product, wherein a first package portion having a pivotable closing member is first operably engaged with a peripheral flange of a second package portion so as to form an enclosure for containing the product therein. Each enclosure portion has a major surface such that the major surfaces of the respective enclosure portions are generally parallel when the first and second enclosure portions are operably engaged. A portion of the peripheral flange corresponding to the closing member is then undercut so as to form opposing first and second components of a locking mechanism. The components of the locking mechanism are operably engageable and configured in an interference fit, with respect to pivoting of the closing member, to secure the closing member to the second enclosure portion. The first and second components are further configured to be separable to as to allow separation thereabout of the closing member from the second enclosure portion.

Thus, embodiments of the present invention provide methods of forming a recloseable package for a product which achieve the benefits of thermoforming processes, namely lower cost and higher processing speeds, while at the same time provide the recloseable features of conventional injection molded packages wherein certain edges and surfaces of the molded pieces can be shaped to interlock when the package is closed. By forming the locking mechanism after assembly of the package, a high correspondence between the components of the locking mechanism may also be achieved.

BRIEF DESCRIPTION OF THE DRAWINGS

Some of the objects and advantages of the present invention having been stated, others will appear as the description proceeds when taken in conjunction with the accompanying drawings, which are not necessarily drawn to scale, wherein.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
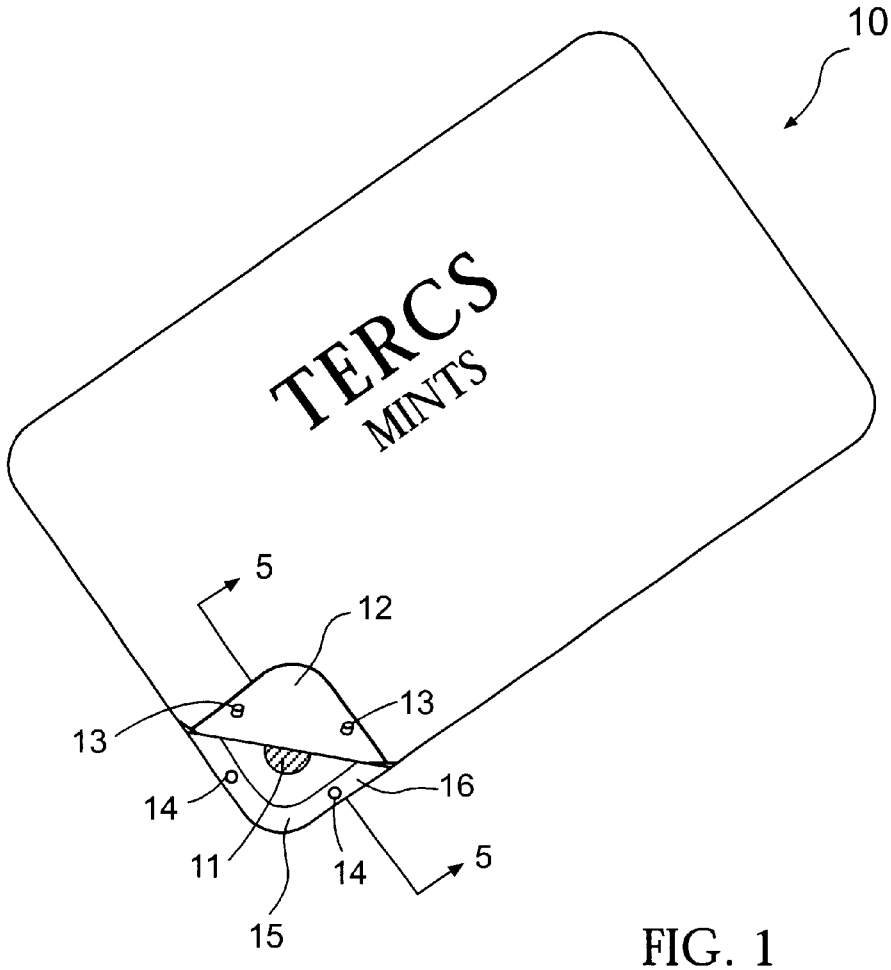
FIG. 1 is a perspective view of a package according to the present invention showing a corner portion thereof in an open position.

FIG. 1 illustrates a package 10 according to the invention for packaging consumable items 11. The term "consumable items" is intended to be broad and cover all types of items which may be packaged including mints and other candies, pharmaceutical products such as pills, tablets and the like and any other products of use to a consumer which can be packaged in packaging of the type discussed herein. When viewed in plan, the package 10 can have the approximate size of a conventional credit card although the thickness of the package can be somewhat larger than the thickness of a credit card. The package 10 is thus of a convenient size and shape for carrying items which may be intermittently consumed, such as mints.

A corner portion 12 of the package 10 is shown in FIG. 1 in an open position, which allows removal of consumable items 11 from the package. Although not illustrated, the package 10 may be provided with one or more internal gates, passageways or channels that permit the dispensing of only one consumable item 11 at a time from the package 10. The corner portion 12 includes a pair of locking projections 13 which, as discussed in more detail below, lock the corner portion 12 in a closed position. The locking projections 13 are received and engaged by corresponding openings 14 in the lower tray 15 of the package 10. The corner portion 12 is shown in a closed position in FIG. 2 such that only the upper sides of the locking projections 13 are visible.

Figure 3:
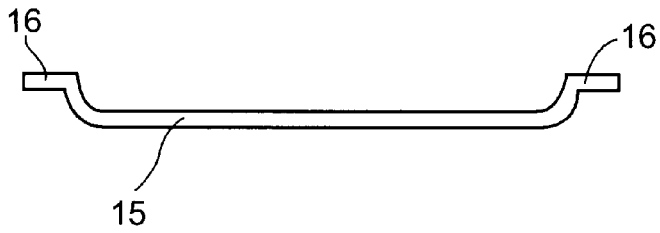
FIG. 3 is a cross sectional view of a lower tray of the package.

The formation of the package 10 according to the present invention is illustrated in FIGS. 3–10. FIG. 3 illustrates the configuration of the lower tray 15. The lower tray 15 is formed by thermoforming a sheet or web of thermoformable material such as polyvinylchloride (PVC). The sheet can have a thickness of 20–25 mils, which results in a relatively rigid lower tray 15. The sheet of thermoformable material is advanced continuously or indexed into a thermoformer that has corresponding projections and depressions in a matching pair of forming dies, as would be understood by one of ordinary skill in the art. For example, for the lower tray 15 illustrated in FIG. 3, the upper forming die may include a projection having a shape corresponding to the upper surface of the lower tray 15 and the lower forming die may have a corresponding depression corresponding to the lower surface of the lower tray 15. As would be further understood by one of ordinary skill in the art, the sheet of thermoformable material may include multiple rows and columns of blanks each corresponding to an individual lower tray 15. At some subsequent point in the manufacturing process, such as after the packages have been filled and sealed, a cutting die or other sharp member can be used to cut the sheet between the blanks to form individual packages. The lower tray 15 includes a peripheral flange 16 which extends around the periphery of the lower tray 15. The peripheral flange 16 can be wider at portions underlying the corner portion 12 to more readily accommodate the openings 14.

Figure 4:
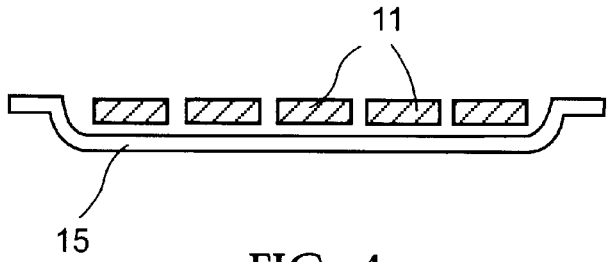
FIG. 4 is a cross sectional view like FIG. 3 illustrating the placement of consumable items therein.

After the formation of the lower tray 15, the tray 15 is filled with consumable items 11, as shown in FIG. 4. As one example, the tray 15 may be filled with fifty (50) small mints.

Figure 5:
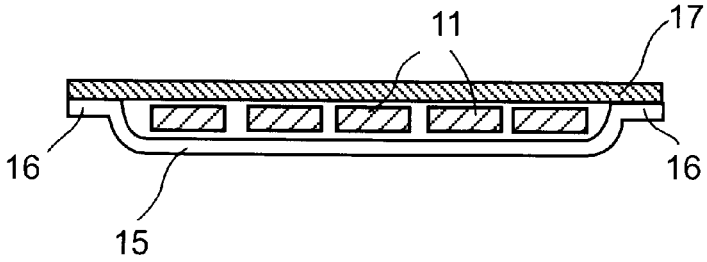
FIG. 5 is a cross sectional view like FIG. 4 illustrating the position of a foil layer over the consumable items.

After the consumable items 11 have been placed in the lower tray 15, a sealing member such as an aluminum foil layer 17 is applied over the lower tray, as shown in FIG. 5. Specifically, the foil layer 17 is heat-sealed at its peripheral edges to the peripheral flange 16 of the lower tray 15. In this fashion, the consumable items 11 are hermetically sealed within the space defined by the lower tray 15 and the foil layer 17. This hermetic seal is broken when the consumer first opens the package 10, as discussed in more detail below. The use of the foil layer 17 provides a convenient moisture barrier and tamper-evident function which eliminates the need for a plastic wrapper covering the entire package of the type used in prior credit card-type packages. Although referred to as a foil layer 17, it will be understood that the sealing member may comprise any suitable material having appropriate barrier properties and/or tamper-evident indication capabilities. One example of an alternative material is polyester film.

Figure 6:
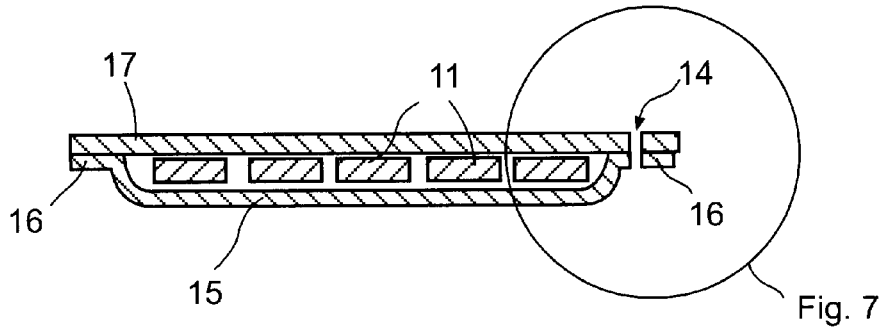
FIG. 6 is a cross sectional view like FIG. 5 illustrating the position of an opening formed through the foil layer and lower tray.
Figure 7:
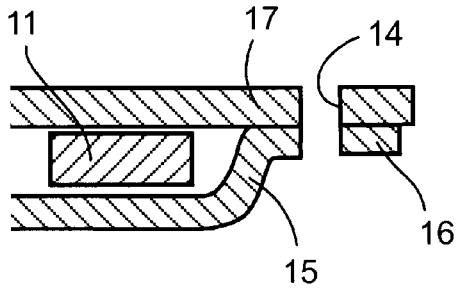
FIG. 7 is an enlarged view of the encircled portion of FIG. 6.

One or more openings 14 are then formed through the foil layer 17 and the peripheral flange 16 of the lower tray 15, as shown in FIG. 6. Only one opening 14 is illustrated in more detail in FIG. 7, although it is to be understood that one or more openings can be used. For example, as shown in FIG. 1, two openings 14 are used for locking the corner portion 12 to the peripheral flange 16 of the lower tray 15. The openings 14 can be formed in any conventional way including die punching and the like, provided that the resulting opening has relatively well-defined edges for securely retaining the locking projections 13. In addition, the shape of the openings is not necessarily circular as illustrated. Circular openings may have a diameter of approximately 2 mm.

A cover member 20 is then placed over the foil layer 17. The cover member 20, which may be formed of the same material as the lower tray 15, is sealed to the upper surface of the foil layer 17. A lacquer applied to the lower surface of the cover member 20 or an adhesive separately applied is heated during the sealing operation to seal the cover member 20 to the foil layer 17. The distal edge of the cover member 20 may extend beyond the distal edge of the peripheral flange 16 by a small distance. The purpose for the slight overhang of the cover member 20 is to assist in opening of the corner portion 12, as discussed in more detail below.

Figure 8:
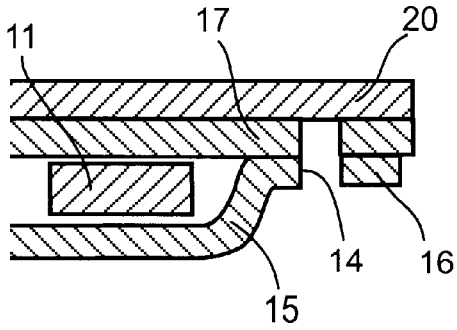
FIG. 8 is a view like FIG. 7 illustrating the position of a cover member.
Figure 9:
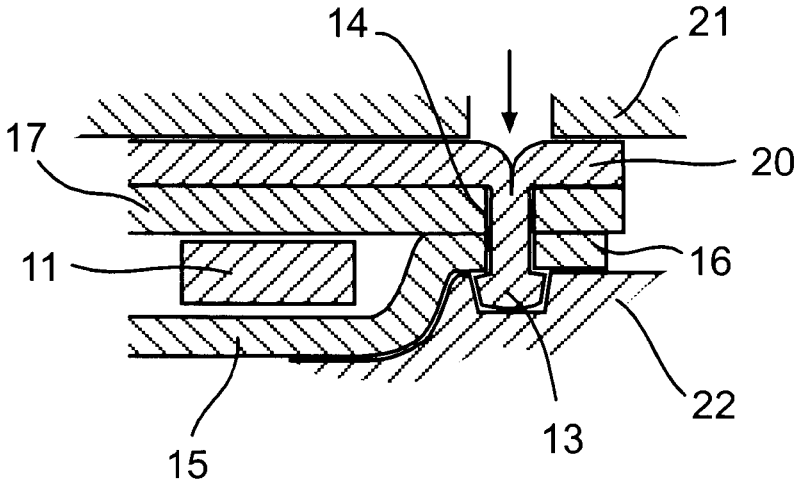
FIG. 9 is a view like FIG. 8 illustrating the thermoforming of a locking projection extending through the foil layer and a flange of the lower tray.
Figure 10:
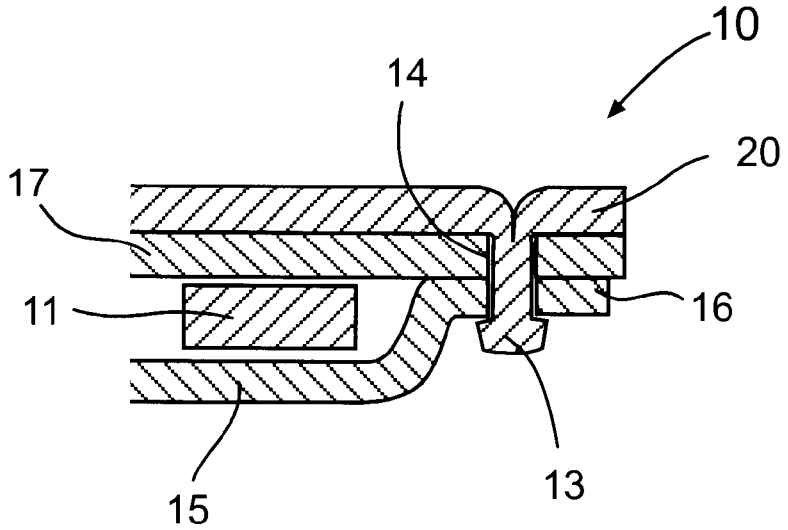
FIG. 10 is a view like FIG. 9 illustrating the locking projection after formation thereof.

The structure illustrated in FIG. 8 is then advanced into a thermoforming station comprising an upper die 21 and a lower die 22. The upper die 21 is heated and defines an opening above the opening 14 in the foil layer 17 and lower tray 15. The lower die 22 defines a cavity which is sized at its top edge slightly larger than the opening 14 extending through the lower tray 15. In one embodiment, the cavity can be tapered as shown at a 60° angle and define an upper opening that has a diameter approximately 0.015 inches larger than the diameter of the opening 14. The cavity can be approximately 2 mm deep. Air is pressurized through the opening in the upper die 21 in the direction of the arrow. The heat from the upper die 21 heats the thermoplastic material of the cover member 20 and the air forces the material through the opening 14 and into the cavity of the lower die 22. If necessary, a die member, which may be heated, can be pushed into the opening to create a "plug assist" for helping to move the molten material into the opening 14. The lower die 22 is cooled and the molten polymer of the cover member material is cooled and solidified in the shape of the cavity, as shown in FIG. 9. If desired, the step of sealing the cover member 20 to the foil layer 17 can also be performed contemporaneously by the upper and lower dies 21, 22. The upper and lower dies 21, 22 are then withdrawn and the resultant finished structure is illustrated in FIG. 10.

The package 10 is then shipped to the consumer and the consumable items 11 are hermetically sealed within the cavity defined by the foil layer 17 and the lower tray 15. When the consumer purchases the package 10 and endeavors to open the package 10, the consumer first engages the distal edge of the foil layer 17 and/or cover member 20 at the corner portion 12. The overhanging portion of the cover member 20 is a signal to the consumer not to attempt to delaminate the cover member 20 from the lower tray 15 by inserting a fingernail or other sharp member between the cover member 20 and the lower tray 15.

Figure 2:
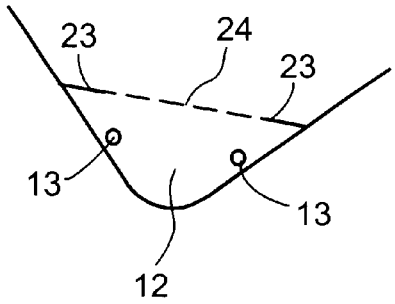
FIG. 2 is a portion of FIG. 1 illustrating the corner portion in a closed position.

A pair of cuts 23 are formed through the cover member 20, foil layer 17 and peripheral flange 16 between the corner portion 12 and the remainder of the package 10. Also, a score line 24 is formed between the cuts 23 as can be seen in FIG. 2. When the package 10 is opened and the corner portion 12 is lifted the corner portion 12 is folded along the cuts 23 and score line 24 to define a hinge as well as a generally triangular shaped corner portion. After a consumable item 11 is removed, the corner portion 12 is folded back along the cuts 23 and score line 24 to close the package 10. Specifically, the locking projections 13 of the cover member 20 are inserted back into the openings 14 in the peripheral flange 16 of the lower tray 15. Because of the shape of the locking projections 13 formed during the thermoforming process, the locking projections 13 engage the openings 14 in a snap fit and lock the corner portion 12 in the closed position. Thus, the thermoformed locking projections 13 form a secure interlocking fit without the need for expensive injection molded profiles of interlocking projections. In addition, manufacturing speeds of up to 400 packages per minute can be achieved.

Another advantageous feature of the present invention is that the foil layer 17 provides a tamper-evident function. When the corner portion 12 is opened, the foil layer 17 may remain adhered to the peripheral flange 16. An intact foil layer 17 signals to the consumer that the package 10 has not been tampered with and the foil layer 17 can then be punctured to gain access to the consumable items 11.

In addition, the condition of the hinge indicates to the consumer whether the package 10 has been previously opened. The hinge appearance will change when opened and may, for example, appear slightly cracked. Thus, if the foil layer 17 remains adhered to the cover member 20 when the corner portion 12 is opened, the absence of any tampering is indicated by the hinge. The heat sealing head that seals the cover member 20 to the foil layer 17 may be knurled to encourage the foil layer 17 to remain adhered to the cover member 20 when the package 10 is opened. If an extra level of tamper-evident protection is desired, the package 10 can also be wrapped with a film wrapper or a frangible band around the corner portion 12.

Figure 11A:
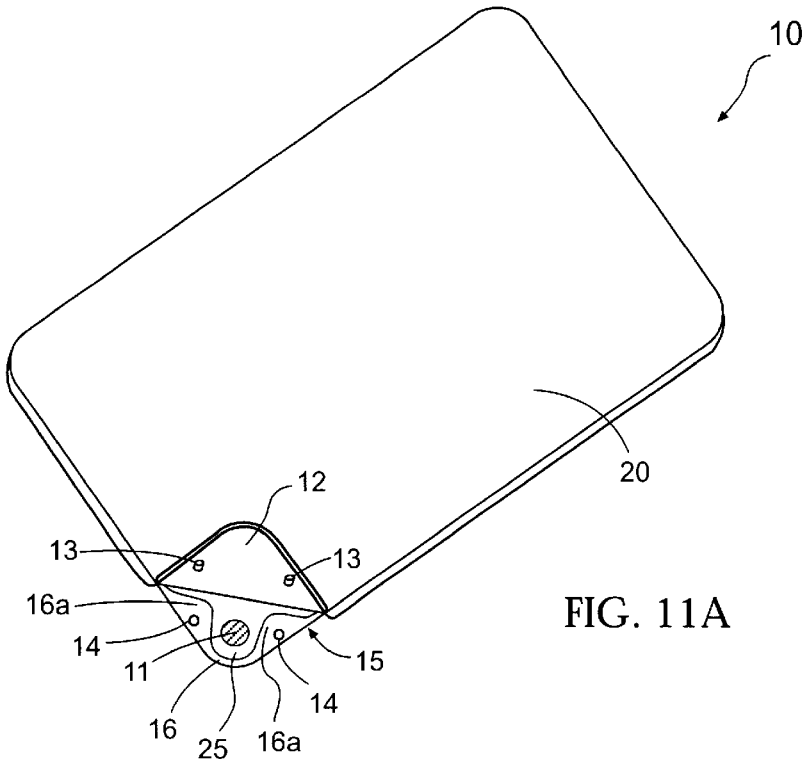
FIGS. 11A and 11B are perspective views of a package according to an alternate embodiment of the present invention showing a corner portion thereof in an open position and a closed position, respectively.
Figure 11B:
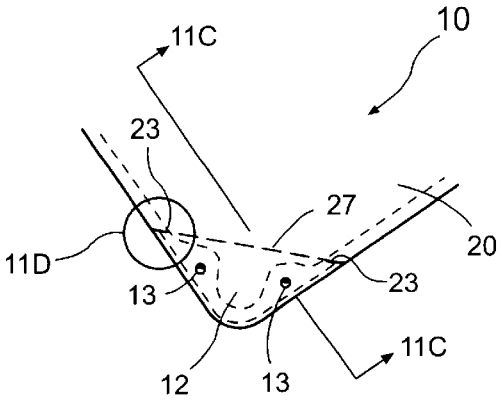

FIGS. 11A and 11B illustrate an alternate embodiment of a package 10 according to the present invention. This alternate embodiment eliminates the foil layer 17, as previously discussed herein, such that the cover member 20 is directly sealed to the lower tray 15, such as by thermal bonding. However, even though the foil layer 17 is not present, the package 10 according to this embodiment is configured to provide tamper-evident features as discussed in more detail below. As shown in FIG. 11A, the lower tray 15 may include a pair of flange projections 16*a* extending inwardly from the peripheral flange 16 so as to form a passageway 25 therebetween. The passageway 25 allows removal of the consumable items 11 from the package 10. The corner portion 12 includes a pair of locking projections 13 for locking the corner portion 12 in a closed position. The locking projections 13 are received and engaged by corresponding openings 14 in the respective flange projections 16*a* of the lower tray 15. An advantage of this alternate embodiment is that the width of the peripheral flange 16 may be reduced since the flange projections 16*a* accommodate the openings 14. Accordingly, less material may be required to form the lower tray 15 and/or the capacity of the package 10 may be increased without increasing the outer dimensions thereof.

The corner portion 12 is shown in a closed position in FIG. 11B such that only the upper sides of the locking projections 13 are visible. To define the corner portion 12, a pair of cuts 23 are formed that extend through the peripheral flange 16 and, in some instances, may partially extend into the cover member 20. Thus, one corner of the package 10 defines one point of the triangular corner portion 12, while the cuts 23 define the remaining two points of the corner portion 12. In some instances, the cuts 23 are angled toward each other so as to define a straight line 27. The cuts 23 are shown from a plan view in FIG. 11B and from a side view in FIG. 11D corresponding to the circled area labeled 11D in FIG. 11B. The cuts 23 may be formed with, for example, a knife or a steel rule and die. In some instances, the cuts 23 may be angled with respect to the vertical plane.

Figure 11C:
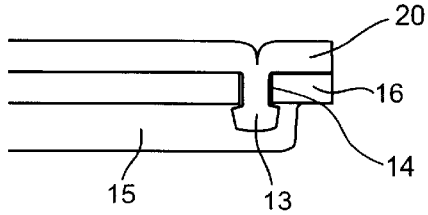
FIG. 11C is a partial cross sectional view along line 11C—11C of FIG. 11B illustrating the locking projection thereof.
Figure 11D:
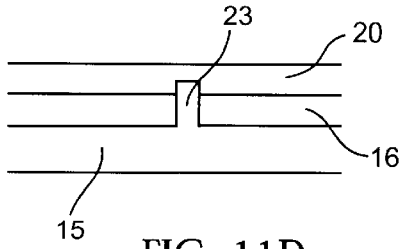
FIG. 11D is an enlarged partial side view of the encircled portion of FIG. 11B.

As such, when the package 10 is opened by lifting the corner portion 12, the cuts 23 cause the corner portion 12 to folded along a line 27 between the cuts 23 so as to form a hinge and define a generally triangular shaped corner portion. The locking projections 13 of the cover member 20 are also withdrawn from the openings 14 in the projections 16*a*. In some instances, an adhesive seal between the corner portion 12 and the corresponding portion of the peripheral flange 16 may also be broken when the package 10 is opened. Folding the corner portion 12 along the line 27 causes deformation of the material comprising the package 10 along the line 27 comprising the hinge. The deformation of the material is preferably visible to the consumer, such as, for example, where the material changes color when deformed. Accordingly, visible deformation of the corner portion 12 about the line 27 would comprise, for instance, a tamper-evident indicator for the consumer. In some instances, the folding of the corner portion 12 may be facilitated by appropriately scoring along the hinge area on the side of the cover member 20 facing the lower tray 15 such that the scored area is not readily apparent until the corner portion 12 is opened. After a consumable item 11 is removed, the corner portion 12 is folded back along the line 27 to close the package 10 by inserting the locking projections 13 of the cover member 20 into the openings 14 in the projections 16*a* of the lower tray 15 in a snap fit, as shown in FIG. 11C.

Figure 12A:
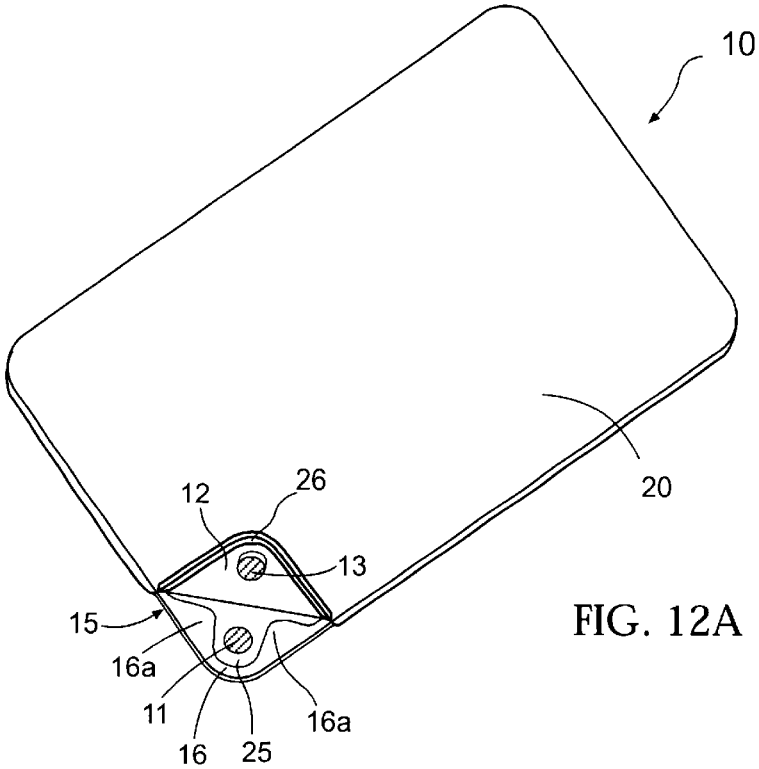
FIGS. 12A and 12B are perspective views of a package according to another alternate embodiment of the present invention showing a corner portion thereof in an open position and a closed position, respectively.
Figure 12B:
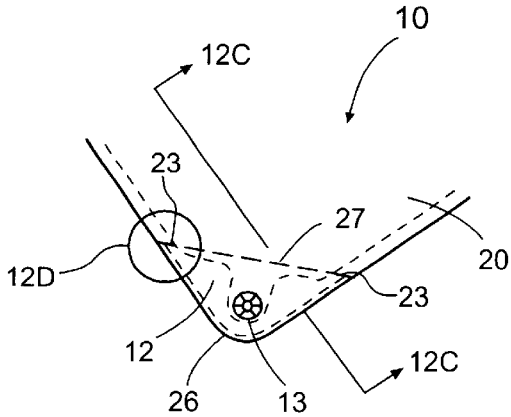

FIGS. 12A and 12B illustrate another alternate embodiment of a package 10, according to the present invention, having the foil layer 17 eliminated such that the cover member 20 is directly sealed to the lower tray 15. However, even though the foil layer 17 is not present, the package 10 according to this embodiment is configured to provide tamper-evident features as discussed in more detail below. As shown in FIG. 12A, the lower tray 15 also includes a pair of flange projections 16*a* extending inwardly from the peripheral flange 16 so as to form a passageway 25 for allowing removal of the consumable items 11 from the package 10. The corner portion 12 includes a locking projection 13 for locking the corner portion 12 in a closed position, wherein the locking projection 13 is received and engaged by the passageway 25 defined by the flange projections 16*a* of the lower tray 15. An advantage of this alternate embodiment is that the width of the peripheral flange 16 or, in some instances, the flange projections 16*a*, may be further reduced since the passageway 25 engages the locking projection 13 and no additional corresponding opening is required therefor. Accordingly, less material may be required to form the lower tray 15 and/or the capacity of the package 10 may be additionally increased without increasing the outer dimensions thereof. Note that, in some instances not including the flange extensions 16*a*, the inner edge of the peripheral flange 16 may be sufficient for interacting with the locking projection 13, in an interference fit, to lock the corner portion 12 in a closed position.

The corner portion 12 is shown in a closed position in FIG. 12B such that only the upper side of the locking projection 13 is visible. In a commercial embodiment, the upper side of the locking projection 13 may be covered by an adhesive label or the like to improve the aesthetic appearance of the package. Further, in order to define the corner portion 12, a pair of cuts 23 are formed that extend through the peripheral flange 16 and, in some instances, may partially extend into the cover member 20. Thus, one corner of the package 10 defines one point of the triangular corner portion 12, while the cuts 23 define the remaining two points of the corner portion 12. In some instances, the cuts 23 are angled toward each other so as to define a straight line 27. The cuts 23 are shown from a plan view in FIG. 12B and from a side view in FIG. 12D corresponding to the circled area labeled 12D in FIG. 12B. The cuts 23 may be formed with, for example, a knife or a steel rule and die. In some instances, the cuts 23 may be angled with respect to the vertical plane.

Figure 12C:
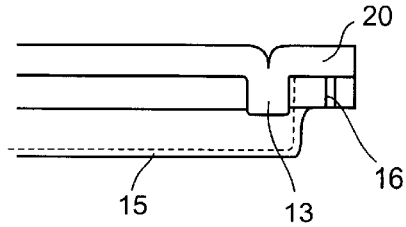
FIG. 12C is a plan view of the package of FIG. 12A illustrating the corner portion thereof in a closed position.
Figure 12D:
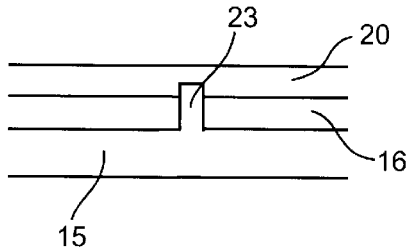
FIG. 12D is an enlarged partial side view of the encircled portion of FIG. 12B

As such, when the package 10 is opened by lifting the corner portion 12, the cuts 23 cause the corner portion 12 to folded along a line 27 between the cuts 23 so as to form a hinge and define a generally triangular shaped corner portion. The locking projection 13 of the cover member 20 is also withdrawn from the passageway 25. In some instances, an adhesive seal between the corner portion 12 and the corresponding portion of the peripheral flange 16 may also be broken when the package 10 is opened. Folding the corner portion 12 along the line 27 causes deformation of the material comprising the package 10 along the line 27 comprising the hinge. The deformation of the material is preferably visible to the consumer, such as, for example, where the material changes color when deformed. Accordingly, visible deformation of the corner portion 12 about the line 27 would comprise, for instance, a tamper-evident indicator for the consumer. In some instances, the folding of the corner portion 12 may be facilitated by appropriately scoring along the hinge area on the side of the cover member 20 facing the lower tray 15 such that the scored area is not readily apparent until the corner portion 12 is opened. After a consumable item 11 is removed, the corner portion 12 is folded back along the line 27 to close the package 10 by inserting the locking projection 13 of the cover member 20 into the passageway 25 of the lower tray 15. The close proximity of the locking projection 13 to the flange projections 16*a* defining the passageway 25 causes the locking projection 13 to engage the passageway 25 in a snap or interference fit, as shown in FIG. 12C, to lock the corner portion 12 in a closed position. Note that, for example, the cover member 20 could be formed separately from the lower tray 15 and the locking projection 13 could be provided with an undercut profile so as to enhance the locking effect with flange projections 16*a* having complementary shapes.

Figure 13A:
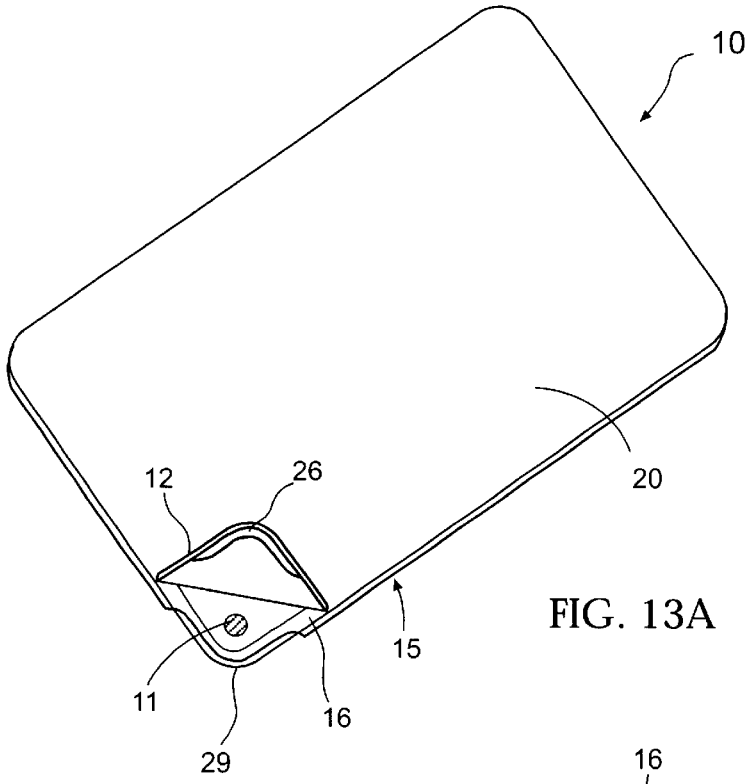
FIGS. 13A and 13B are perspective views of a package according to another alternate embodiment of the present invention showing a corner portion thereof in an open position and a closed position, respectively.
Figure 13C:
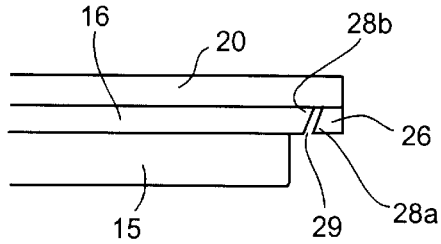
FIG. 13C is a plan view of the package of FIG. 13A illustrating the corner portion thereof in a closed position.
Figure 13B:
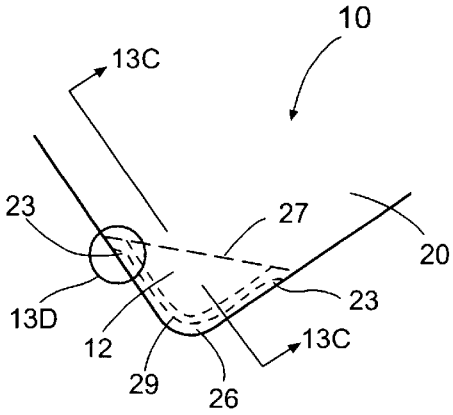

FIGS. 13A and 13B illustrate yet another alternate embodiment of a package 10 according to the present invention. This embodiment also eliminates the foil layer 17, as previously discussed herein, such that cover member 20 is directly sealed to the lower tray 15. Even so, the package 10 is configured to provide tamper-evident features as described in more detail below. As shown in FIG. 13A, the corner portion 12 includes lip 26 for locking the corner portion 12 in a closed position, wherein the lip 26 is engaged by a portion of the peripheral flange 16 of the lower tray 15. An advantage of this alternate embodiment is that the width of the peripheral flange 16 may be configured to be minimal since interlocking locking projections 13 and corresponding openings 14 are not required. Accordingly, less material may be required to form the lower tray 15 and/or the capacity of the package 10 may be additionally increased without increasing the outer dimensions thereof. Such a configuration may also provide a less restricted opening through which the consumable items 11 are extracted from the package 10.

Figure 13D:
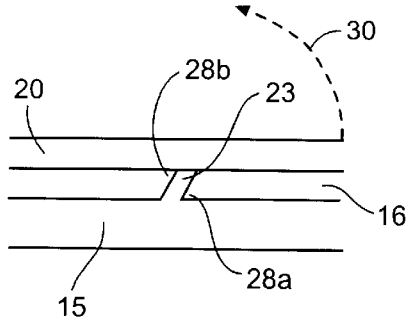
FIG. 13D is an enlarged partial side view of the encircled portion of FIG. 13B.

The corner portion 12 is shown in a closed position in FIG. 13B. As shown, the lip 26 extends along the periphery of the corner portion 12 about the corner of the package 10. The lip 26 is terminated at each end thereof by a cut 23 extending through the peripheral flange 16 to the cover member 20. Preferably, the cut 23 is angled with respect to the vertical plane so as to extend into the peripheral flange 16 at an angle directed away from the folding line 27 along which the corner portion 12 is folded when the package 10 is opened, as shown in FIG. 13D and corresponding to the encircled area of FIG. 13B labeled 13D. The cuts 23 thereby form a locking mechanism between the lip 26 and the peripheral flange 16 that will be described below in further detail. In some instances, the lip 26 comprises a portion of the peripheral flange 16. More particularly, the cover member 20 is first sealed to the lower tray 15 according to a process as previously described. Subsequently, the package 10 is subjected to a perforation process whereby the cuts 23 are formed through the peripheral flange 16. In addition, further to or concurrently with the formation of the cuts 23, the inner ends of the cuts 23 are joined by a joining cut 29 through the peripheral flange 16 and spaced apart from and corresponding to the periphery of the edges of the corner portion 12. The joining cut 29 may extend through the peripheral flange 16 in the vertical plane or, in some instances, may be angled away from the folding line 27 as the joining cut 29 proceeds through the peripheral flange 16 toward the cover member 20, as shown in FIG. 13C. The cuts 23 and joining cut 29 may be formed with, for example, a knife or a steel rule and die.

In some instances, the folding of the corner portion 12 may be facilitated by appropriately scoring along the hinge area on the side of the cover member 20 facing the lower tray 15, before the cover member 20 is sealed to the lower tray 15, such that the scored area is not readily apparent until the corner portion 12 is opened. Further, as shown in FIGS. 13A and 13B, the cuts 23 defining the termination of the lip 26 may be spaced apart from the folding line 27 though, according to various embodiments of the invention, the cuts 23 may be disposed at any point along the corresponding edges of the corner portion 12 so as to define a lip 26 with varying dimensions.

As shown in FIGS. 13C and 13D, the angled cuts 23 and/or joining cut 29 results in an underlying edge 28*a* on the lip 26 generally opposing an overhanging edge 28*b* on the corresponding portion of the peripheral flange 16 in an interference fit. As the corner portion 12 is opened by lifting the lip 26, in the direction of the dashed arrow 30 as shown in FIG. 13D, the underlying edge 28*a* must be forced past the overhanging edge 28*b*. As such, the interaction of the underlying edge 28*a* and the overhanging edge 28*b* comprises a locking mechanism as the corner portion 12 of the package 10 is opened and closed. Note that, in other instances, the angled cuts 23 may be formed in a variety of orientations with respect to the direction of each angled cut 23 and will provide a similar function as long as the peripheral flange 16 includes the overhanging edge 28*b*.

Further, in some instances, an adhesive seal between the corner portion 12 and the corresponding portion of the peripheral flange 16 may also be broken when the package 10 is opened. Also, folding the corner portion 12 along the line 27 may cause deformation of the material comprising the package 10 along the line 27 comprising the hinge. The deformation of the material is preferably visible to the consumer, such as, for example, where the material changes color when deformed. Accordingly, visible deformation of the corner portion 12 about the line 27 would comprise, for instance, a tamper-evident indicator for the consumer.

After a consumable item 11 is removed, the corner portion 12 is folded back along folding line 27 to close the package 10 by urging the underlying edge 28*a* of the lip 26 over the overhanging edge 28*b* of the peripheral flange 16. The close proximity of the underlying edge 28*a* to the overhanging edge 28*b* causes a snap or interference fit engagement, as shown in FIGS. 13C and 13D, when locking the corner portion 12 in a closed position.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. For example, conventional blister packages could be improved by fastening a cover member over the lid stock by way of multiple locking projections extending into flange portions of the blister web material. Thus, the cover member must be first removed before pharmaceuticals can be punched through the lidstock, thereby providing additional resistance to opening by children. Another example would be eliminating any lacquer or adhesive used to adhere the cover member to the foil layer and providing one or more locking projections across the width of the package that are engaged in blisters formed upwardly from the lower tray and having openings formed therein, thereby mechanically interlocking the lower tray and the cover member. Although specific terms are employed herein, they are used in a generic and descriptive sense only and not for purposes of limitation.

That which is claimed:

1. A method of forming a thermo formed recloseable flat package for a pill-like product, said method comprising:

operably engaging a first enclosure portion having a closing member with a second enclosure portion defining at least one aperture component of a locking mechanism so as to form an enclosure for containing the product therein, each enclosure portion having a major surface such that the, major surfaces of the respective enclosure portions are generally parallel when the first and second enclosure portions are operably engaged;

forming a pair of cuts, each cut extending through at least one of the first enclosure portion and the second enclosure portion, the cuts being separated by a corner of the enclosure to thereby define the closing member as extending between the cuts and from each cut to the corner; and forming a projection component of the locking mechanism from the closing member following formation of the enclosure, the projection component corresponding to, and configured to extend through, the at least one aperture component to secure the closing member to the second enclosure portion, the components of the locking mechanism being further configured to be separable so as to allow separation thereabout of the closing member from the second enclosure portion to thereby define the reclosable package capable of selectively allowing the product to be extracted from the enclosure.

2. A method according to claim 1 further comprising disposing the product within at least one of the first and second enclosure portions prior to operably engaging the first enclosure portion with the second enclosure portion.

3. A method according to claim 2 further comprising operably engaging a sealing member with the enclosure portion housing the product prior to operably engaging the first and second enclosure portions.

4. A method according to claim 1 further comprising plasticizing the closing member about a point opposing the at least one aperture component.

5. A method according to claim 4 further comprising reshaping the closing member about the point, following plasticization thereof, so as to form the projection component such that the protection component is configured to extend through the at least one aperture component.

6. A method according to claim 1 further comprising plasticizing the closing member about a point opposing the at least one aperture component with a heated die operably engaged with the closing member.

7. A method according to claim 6 further comprising reshaping the closing member about the point, following plasticization thereof, with a mechanism capable of engaging the closing member, so as to form the projection component, the projection component extending through the at least one aperture component, the mechanism comprising at least one of a heated member extending through the die and pressurized air introduced through the die.

8. A method according to claim 7 further comprising receiving a portion of the projection component extending through the at least one aperture component with a receiving die operably engaged with the second enclosure portion, the receiving die being configured to reshape the portion of the projection component extending through the at least one aperture component so as to form a retention lip.

9. A method according to claim 8 further comprising rigidifying the closing member about the point, the projection component, and the retention lip following formation of the retention lip.

10. A method according to claim 1 wherein the second enclosure portion further includes a peripheral flange defining the at least one aperture component and operably engaging the first enclosure portion with the second enclosure portion further comprises operably engaging the first enclosure portion to the peripheral flange of the second enclosure portion.

11. A method according to claim 1 further comprising scoring between the cuts so as to form a fold line, the closing member being pivotable about to cold line.

* * * * *

UNITED STATES PATENT AND TRADEMARK OFFICE

CERTIFICATE OF CORRECTION

PATENT NO. : 6,625,955 B2
DATED : September 30, 2003
INVENTOR(S) : Aylward

It is certified that error appears in the above-identified patent and that said Letters Patent is hereby corrected as shown below:

Column 11,
Line 66, “thermo formed” should read -- thermoformed --.

Column 12,
Line 6, after “the” cancel the comma (,);
Line 41, “protection” should read -- projection --.

Column 14,
Line 3, “to cold” should read -- the fold --.

Signed and Sealed this

Twentieth Day of January, 2004

JON W. DUDAS
*Acting Director of the United States Patent and Trademark Office*